United States Patent [19]

Scripps et al.

[11] Patent Number: 4,717,910

[45] Date of Patent: Jan. 5, 1988

[54] DETECTOR AND LIGHT ASSEMBLY

[76] Inventors: Keith A. Scripps, 4301 Massachusetts Ave., NW., Washington, D.C. 20016; Thomas C. Driggers, 1836 Griffith Rd., Falls Church, Va. 22043

[21] Appl. No.: 935,219

[22] Filed: Nov. 26, 1986

Related U.S. Application Data

[63] Continuation-in-part of Ser. No. 797,008, Nov. 12, 1985.

[51] Int. Cl.[4] ..... G08B 23/00

[52] U.S. Cl. ..... 340/693; 340/628; 340/691; 340/586

[58] Field of Search ..... 340/693, 628, 691, 584, 340/586, 517

[56] References Cited

U.S. PATENT DOCUMENTS

| | | | |
|---|---|---|---|
| 4,090,178 | 5/1978 | Norris | 340/628 |
| 4,093,943 | 6/1978 | Knight | 340/693 |
| 4,255,746 | 3/1981 | Johnson et al. | 340/584 |
| 4,319,229 | 3/1982 | Kirkor | 340/517 |
| 4,365,237 | 12/1982 | Knight | 340/596 |

*Primary Examiner*—Donnie L. Crosland

*Attorney, Agent, or Firm*—Sixbey, Friedman & Leedom

[57] ABSTRACT

The detector and light assembly combines an electrically powered detector and alarm and an electrical light into a single unit which is removably attachable to a conventional light socket. The unit includes a closed housing containing a detector and alarm system and a control circuit. Also recessed flush within the housing is a light bulb socket for reception of a light bulb into a face of the housing, and protruding from an opposite face of the housing is an electrical connector capable of screw-in attachment to a standard socket. The control circuit operates in response to activation of the alarm system to cause a light bulb in the light bulb socket to flash off and on. Otherwise, illumination of the bulb is controlled by a manual switch installed within the housing such that the switch is operable from outside the housing.

14 Claims, 3 Drawing Figures

DETECTOR AND LIGHT ASSEMBLY

This application is a continuation in part application of copending Ser. No. 797,008, filed on Nov. 12, 1985, by Keith A. Scripps, and entitled Combination Electrical Light, Smoke And/Or Heat Detector.

TECHNICAL FIELD

The present invention relates generally to alarm detectors for sensing the occurrence of a dangerous condition and providing an alarm indicative of the presence of the condition, and more particularly to a detector combined with a conventional electric light and adapted to be mounted in any conventional electric light socket.

BACKGROUND ART

Property loss, personal injury and loss of life due to fire can often be minimized or avoided when smoke or heat detectors are employed to provide an alarm during the initial stages of a fire. Consequently, local law in many jurisdictions requires that smoke and heat detectors with alarms be provided in public and commercial buildings and private homes. This has led to the development of a wide variety of commercially available smoke and heat detectors which are battery operated or are wired into the electrical circuit for a building.

The least expensive gas, heat and smoke detectors are battery operated, and these units may be permanently installed upon walls or ceilings in an area to be protected. The batteries in these units must be periodically replaced, and generally such units provide an intermittent alarm signal when the battery charge drops below a predetermined level. U.S. Pat. No. 4,227,191 to Samuel Raber illustrates a battery powered smoke detector of this type. Unfortunately, homeowners are prone to remove a weak battery from a smoke detector to silence the low charge warning signal and then neglect to promptly replace the battery. Also, some local laws require that smoke and heat detectors be wired into the 110 V power supply for a building, and in such cases, battery powered units are unacceptable.

Smoke, gas, and heat detectors which are wired into a building power supply are normally permanent installations which must be installed by a qualified electrician, and these units operate continuously on the available house power supply. To preclude the likelihood that such permanently wired detectors will be rendered inoperative by a fire which rapidly disables the building power supply, it is conventional practice to provide these units with battery power from a battery which is recharged from the standard A.C. power supply. If this power supply is discontinued, the detector will continue to operate as long as battery power remains. Such a system is disclosed by U.S. Pat. No. 4,199,754 to R. W. Johnson and W. J. Raddi.

Fire detectors which are wired into a standard household A.C. power supply generally require a separate outlet box for each detector which is installed. In an attempt to eliminate this necessity, combination smoke detector and lamp structures have been provided which can be wired into a single outlet box such as the one installed for a conventional ceiling lamp. Such a structure is illustrated by U.S. Pat. No. 4,090,178 to E. G. Norris.

A common problem experienced with both battery powered and hard wired A.C. powered fire detectors is that they are, in all cases, a permanent installation. If such a detector is inadvertently placed too close to a stove or other source of normal and acceptable smoke or heat, the alarm will be triggered, and the detector must then be either moved to an acceptable location or deactivated and replaced by a new detector. Movement of a fire detector generally involves substantial inconvenience, for wall or ceiling surfaces which have been defaced by the detector mounting must be repaired and repainted, and often the services of an electrician are required to disconnect and reinstall the detector. To eliminate these problems, some attempts have been made to power detectors from existing light sockets, as disclosed by U.S. Pat. No. 4,365,237 to W. B. Knight. Although circuits of this type do operate effectively from a conventional bulb socket, they are unsuitable for use with ceiling sockets as they require the additional mounting surfaces which are provided with a table or floor lamp. This is due to the fact that the detector module constitutes a separately mounted module which is electrically powered from a lamp module but which is otherwise separate and distinct therefrom. In systems of this type, there is no electrical cooperation between the light and detector circuit which operate as independent elements.

The above problems which are inherent in conventional fire detectors, which are the most common type of detetors, are also prevalent in other types of electrically powered detectors.

DISCLOSURE OF THE INVENTION

It is a primary object of the present invention to provide a novel and improved detector with combination light and alarm which can be easily inserted or removed from a conventional incandescent light socket.

Another object of the present invention is to provide a novel and improved detector with combination light and alarm wherein both the light holder and detector unit constitute a unitary assembly which can be easily inserted or removed from a conventional incandescent light socket. An incandescent light may be inserted into a socket in the detector unit and may be operated in a conventional manner to light a room in which the unit is mounted.

A further object of the present invention is to provide a novel and improved detector with combination light and alarm wherein an incandescent light bulb is inserted into a socket in the unit. The light bulb may be operated normally to provide light to an area where the detector is mounted, but is operated by the detector to provide a visual indication of an alarm situation regardless of the position of a control switch for the light.

Yet another object of the present invention is to provide a novel and improved detector with combination light and alarm which includes a light operating switch for a light mounted in the detector unit so that house power can be constantly provided to the detector unit, and the operation of the light may be independently controlled by the detector unit light operating switch. When the light is deenergized by the detector unit light operating switch and an alarm condition occurs, the detector unit causes the light to be intermittently energized to provide a visual alarm.

A still further object of the present invention is to provide a novel and improved detector with combination light and alarm which may both be mounted and connected to house power solely by insertion of a threaded base for the detector into a conventional incandescent light socket. The detector is formed to support lamp covers or reflectors of many designs so that the detector is adapted for use in incandescent fixtures of any type.

These and other objects of the present invention are accomplished by providing a detector with combination light and alarm which includes a housing having a projecting threaded mount and connector assembly adapted for reception by conventional incandescent light sockets. The housing includes a light socket which is connected by electrical control circuitry within the housing to the projecting threaded mount and connector assembly, and this light socket receives a removable incandescent electric light bulb. Operation of the light bulb is controlled by a manual switch included in the electrical control circuitry, and in an alarm condition, is controlled by an alarm activated switching unit in the control circuitry to illuminate intermittently as a visual alarm. Mounted within the housing is a detection unit, which may be a heat detector, smoke detector, gas detector, radiation detector or other suitable detector which provides a fire or other detection function and which may be powered from either house power from the projecting threaded mount and connector assembly or from battery power provided by a standby battery mounted within the housing. The standby battery is charged by a charger unit connected to the threaded mount and connector assembly. To make the detector with combination lamp and alarm suitable for use in many diverse locations, the housing is formed to integrally or removably support lamp covers of various designs.

BEST MODE FOR CARRYING OUT THE INVENTION

Figure 1:
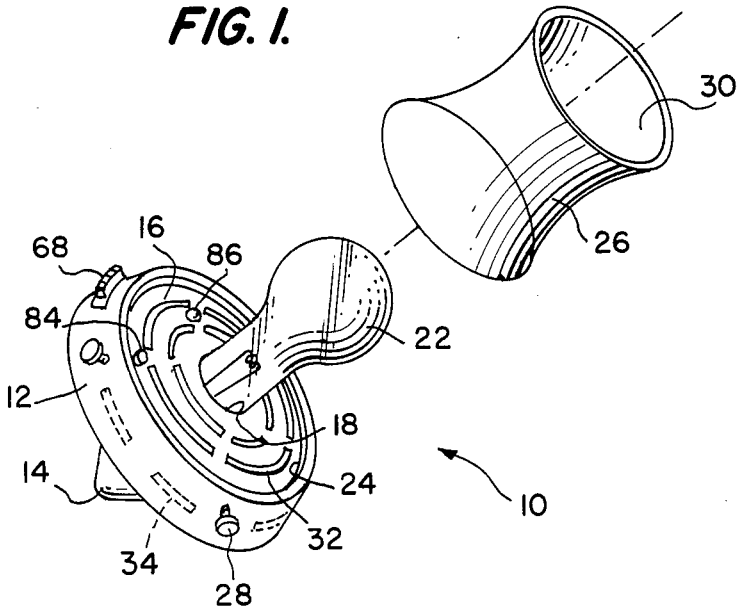
FIG. 1 is a perspective exploded view of the detector with combination lamp and alarm of the present invention.

A preferred embodiment of the detector with light assembly of the present invention is indicated generally at 10 in FIG. 1. This assembly includes a housing 12 having a projecting threaded mount and connector assembly 14 which is identical to the base portion of a conventional incandescent light bulb. The wall 16 of the housing opposite to the mount 14 includes a threaded socket 18 which is a unitary part of the threaded mount and connector assembly, and this socket receives the threaded base 20 of an incandescent bulb 22. Extending outwardly from the wall 16 of the housing is a circular lip 24 within which a conventional lamp cover 26 may be removably mounted by screws 28. Preferrably, the lamp cover 26 in a smoke or gas detector has an open end 30 so that smoke or gas can pass through the open end and into slots 32 formed in the wall 16. However, if the lamp cover has a closed end, slots 34, shown in dotted lines in FIG. 1, may be cut in the sides of the housing 12 to admit smoke or gas.

Figure 2:
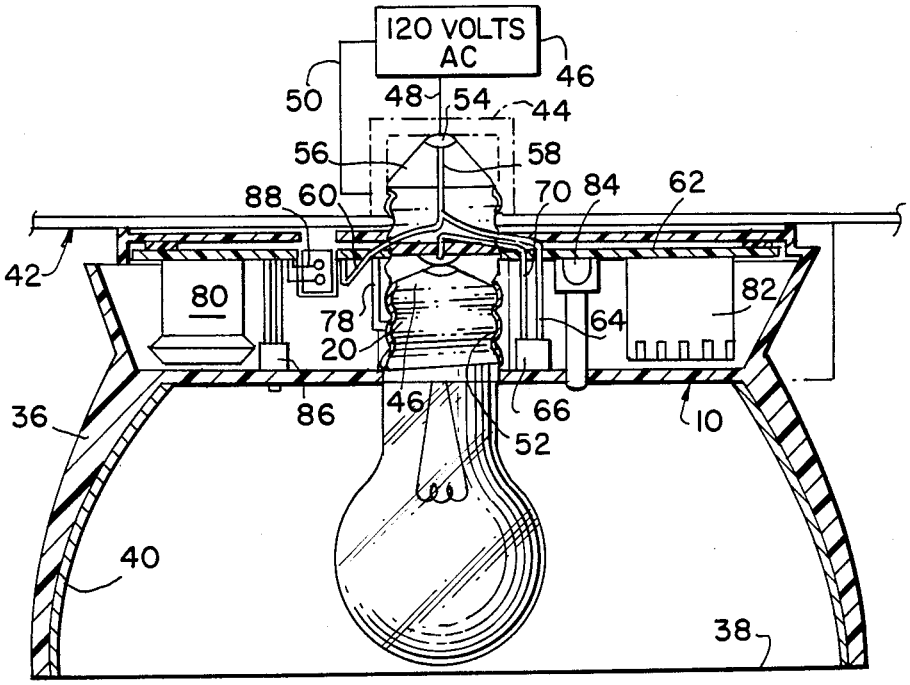
FIG. 2 is a partially diagrammatic sectional view of the detector with combination lamp and alarm of FIG. 1; and, FIG. 3 is a circuit diagram of the electrical control circuit for the detector with combination lamp and alarm of the present invention.

The detector housing 12 and the lamp cover 26 can be constructed as a one-piece unit as illustrated in FIG. 2. Here, the lamp cover may take the form of a reflector or shade 36 having an open side 38 of sufficient area to facilitate removal and replacement of the light bulb 22. This design is quite versatile, and the shade 36 can take many different forms. For overhead use, the shade could be molded as a curved reflector having a light reflecting inner surface 40. Alternatively, the shade could be ornamental and possibly translucent to serve as a conventional light shade when the detector assembly 10 is mounted in a conventional table or floor lamp.

For purposes of illustration in FIG. 2, the detector with light assembly 10 is mounted below a ceiling 42 by means of a conventional ceiling fixture indicated in broken lines at 44. This ceiling fixture includes a light socket unit mounted on a recessed junction box which provides power from the house power supply 46 by means of conductors 48 and 50 to the light socket unit. Such an arrangement is typical in most residences and commercial buildings and is therefore diagrammatically illustrated in FIG. 2.

The threaded mount and connector assembly 14 is screwed into the light socket unit of the ceiling fixture 44 to not only mount the detector and light assembly 10 on the ceiling 42 but also to electrically connect the unit with the power supply 46. Thus, the detector and light assembly may be easily installed and removed.

Figure 3:
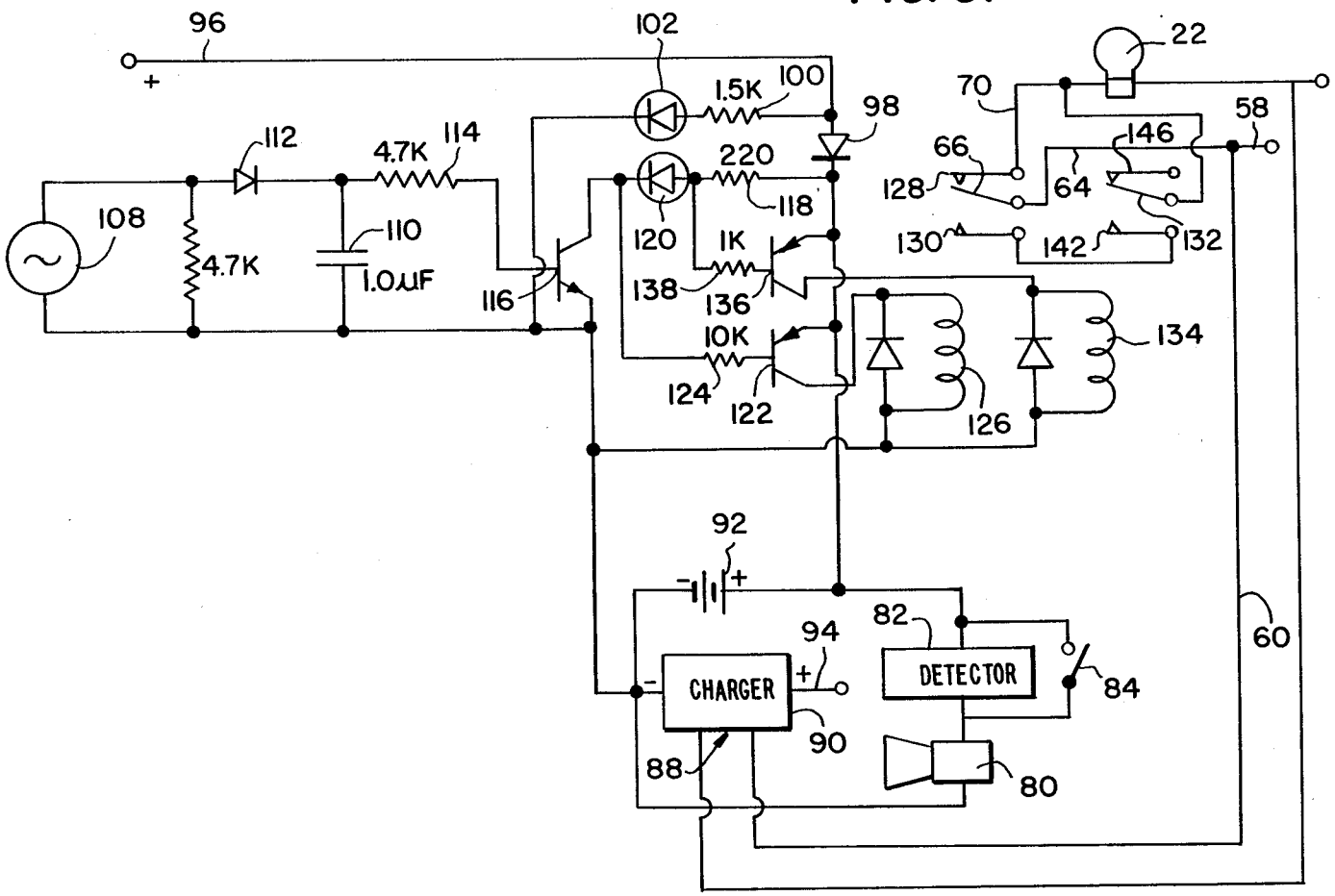

In connection with FIG. 2, the general electrical circuit path through the detector and light assembly is shown in a very basic form for purposes of description, and an accurate circuit diagram of the operative circuit is disclosed in FIG. 3. Once the threaded mount and connector assembly 14 is installed in electrical contact with the ceiling fixture 44, a circuit is completed from the conductor 50 and a conductive sidewall of the light socket unit for the ceiling fixture 44 to a conductive sidewall 52 of the threaded mount and connector assembly. A circuit is also completed from the conductor 48 to a fixture contact 54 positioned at the end of the threaded mount and connector assembly. This fixture contact is separated from the conductive sidewall 52 by an insulation cone 56, so that there is no electrical circuit between the two.

A conductor 58 extends from the fixture contact 54 and splits to provide a first power supply circuit 60 to a detector circuit board 62 and a second power supply circuit 64 to a switch 66. The switch 66 is manually operated by a switch button 68 extending outwardly from the housing 12, or by a pull chain or other known switch actuator. This switch selectively completes or breaks a circuit over a conductor 70 to a bulb socket contact 72 which is mounted within the threaded socket 18 by an insulating divider 74. When the light bulb 22 is screwed into the socket 18, a bulb contact 76 on the threaded base 20 contacts the bulb contact 76. Now, when the switch 66 is activated to complete a circuit, current flows from the bulb contact to the filament and back to the conductive bulb threaded base and to the conductive sidewall 52 of the threaded socket 18.

The detector circuit board 62 includes the detector and alarm components of the detector and light assembly 10 as well as the control circuitry therefor. These elements are powered from the first power supply circuit 60, and the circuit for the detector circuit board is completed by a return line 78 which electrically connects the circuit board to the conductive sidewall 52.

The detector circuit board is doughnut-shaped to fit around the threaded socket 18 and supports an alarm horn 80, a detector 82 for smoke, heat, gas, radiation or some other condition which will result in an alarm condition, a test button assembly 84, and a pilot light 86. A battery circuit 88 is also mounted on the detector circuit board and includes a rechargeable battery and battery charger to provide a power supply for the detector 82 and the alarm horn 80.

In FIG. 3, it will be noted that the battery circuit 88 includes a battery charger 90 and a battery 92 which may be a rechargeable nickel cadmium battery. These units are in a circuit with the detector 82 and the alarm horn 80, so when the detector closes the circuit to the battery, the horn is energized. To test the battery, the test button assembly 84 may be activated to close a shunt circuit to the horn around the detector 82.

The detector and battery circuit can be one of a number of known commercial circuits where a detector closes a circuit from a battery to an alarm device upon the detection of a specific condition. The control circuit of FIG. 3, which assumes control of the energization of the light bulb 22 when the horn 80 is activated, may be used with most battery operated detector circuits.

As previously indicated, power is provided from the conductor 58 over a first power supply circuit 60 to a detector circuit board 62, and this power is provided to the battery charger 90 mounted on the circuit board. To maintain the charge on the battery 92, the positive terminal 94 of the battery charger is connected to a power input line 96 which is connected to a Schottky diode 98, a resistor 100 and an LED 102. Since the diode 98 has a low forward drop characteristic, current is provided across the diode to maintain the charge on the battery 92. However, the diode 98 prevents the battery from discharging across the resistor 100 and LED 102.

When the horn 80 is not activated, current from the input line 96 passes across the resistor 100 and the LED 102 to the negative terminal of the battery charger 90. This illuminates the LED 102 which, with an LED 104, forms the pilot light 86.

Activation of the horn 80 causes a sonically activated transducer 108 to charge a capacitor 110 across a diode 112. Normally, the transducer opens the circuit to the capacitor, but operates to provide power in response to the sonic signal from the horn. The use of a sonically activated transducer permits the control circuit of FIG. 3 to be combined with a variety of battery powered detector and alarm circuits without requiring a number of complex electrical connections. However, the transducer 108 could be replaced by a switching circuit which is connected to close when power is provided to the horn 80 so that the capacitor 110 begins to charge.

The charge on the capacitor 110 developed across a base resistor 114 will ultimately reach a level where a transistor 116 begins to conduct. Current now passes over a resistor 118 and a blinking LED circuit 120 to the conducting transistor 116. The blinking LED circuit is a commercial circuit which flashes on and off as long as current is provided thereto, thus causing the LED to blink and a perdiodically interrupted flow of current to pass across the transistor 116. Other known flasher circuits could be substituted for the LED circuit 120.

The conduction of the transistor 116 initially causes a transistor 122 to conduct, and since the base resistor 124 for the transistor 122 is connected directly to the collector of the transistor 116, the transistor 122 will conduct without interruption while the transistor 116 is conducting. This results in the energization of a solenoid coil 126 for a solenoid switch which includes the switch arm 66. If the switch 66 is manually activated to energize the light 22 by completing a circuit to a switch contact 128 as shown in FIG. 3, energization of the coil 126 will move the switch arm into engagement with a contact 130. On the other hand, if the switch arm has been manually positioned to deenergize the light 22 and thus is already engaged with the contact 130, the energization of the coil 126 will not affect the position of the switch arm.

Once current through the conducting transistor 122 has energized the coil 126 to insure that a circuit is completed from the second power supply circuit 64 to the contact 130, power may be supplied to the light 22 by a reciprocating solenoid switch 132. This switch is operated by a coil 134 which is energized by the conduction of a transistor 136. The transistor 136 is also triggered into conduction by the conduction of the transistor 116, but since current across the base resistor 138 for this transistor must pass across the blinking LED circuit 120, the conduction of the transistor is intermittent in response to the current pulses across the LED circuit. As the transistor 136 switches between conducting and nonconducting states, the coil 134 is periodically energized and deenergized to cause the switch arm for the solenoid switch 132 to move back and forth between contacts 140 and 142. Each time the switch arm engages the contact 142, a circuit is completed to the light bulb 22 from the second power supply circuit 64 and the contact 130. This circuit is broken when the switch arm moves back to the contact 140, and thus the light bulb 22 will blink off and on when the horn 80 is energized. This will occur regardless of the manual position of the switch 66 as long as house power is present on the conductor 58.

INDUSTRIAL APPLICABILITY

The detector with light assembly 10 of the present invention may be installed in any conventional incandescent light socket and operated simultaneously as an electric light and a rechargeable battery operated detector. The assembly includes a light control switch to facilitate manual operation of a light, but in an alarm condition, the light is automatically switched to a blinking mode so that the unit provides both a visual and an audible alarm. The assembly is adapted for combination with decorative or functional light shades or reflectors which may be removably mounted on the unit or formed integrally therewith.

We claim:

1. A detector and light assembly adapted to be removably secured to an incandescent light socket and operative simultaneously as a manually controlled light fixture and an alarm source responsive to a detected alarm condition comprising:

support means, electrically powered alarm circuit means mounted upon said support means, detector means mounted upon said support means, said detector means being connected to said alarm circuit means and operating in response to an alarm condition to activate said alarm circuit means, a socket mounting means secured to said support means and extending outwardly therefrom, said socket mounting means being removably engageable in an incandescent light socket and being operative to complete an electric circuit therewith, light bulb receiving socket means mounted upon said support means, said light bulb receiving socket means being operative to receive and provide power to an electric light bulb, and first power circuit means operative to complete a circuit between said light bulb receiving socket means and said socket mounting means to provide power from said socket mounting means to a light bulb mounted in said light bulb receiving socket means when said socket mounting means completes an electric circuit with an incandescent light socket.

2. The detector and light assembly of claim 1 wherein said first power circuit means includes switching means which is manually operable to complete or break a circuit between said light bulb receiving socket means and said socket mounting means.

3. The detector and light assembly of claim 1 which includes control circuit means operative upon activation of said alarm circuit means, said power circuit means including switching means operable to make or break a circuit between said light bulb receiving socket means and said socket mounting means, said control circuit means operating upon activation of said alarm circuit means to cause said switching means to repetitively make and break the circuit between said socket mounting means and light bulb receiving socket means.

4. The detector and light assembly of claim 3 wherein said switching means includes a manual switching means which is manually operable to complete or break a circuit between said light bulb receiving socket means and said socket mounting means.

5. The detector and light assembly of claim 4 wherein an enclosure means extends from said support means outwardly beyond said light bulb receiving socket means to surround a light bulb when said light bulb is mounted in said light bulb receiving socket means.

6. The detector and light assembly of claim 5 wherein said enclosure means is an open ended reflector.

7. The detector and light assembly of claim 5 wherein said enclosure means is removably mounted upon said support means.

8. The detector and light assembly of claim 1 wherein said support means includes a housing which encloses said alarm circuit means and said power circuit means, said socket mounting means extending outwardly from a first side of said housing and said light bulb receiving socket means opening from a second side of said housing opposite to said first side, and an enclosure means extending outwardly from said second side of said housing to surround a light bulb when said light bulb is mounted in said light bulb receiving socket means.

9. The detector and light assembly of claim 1 which includes second power circuit means operative to provide power from said socket mounting means to said electrically powered alarm circuit means.

10. The detector and light assembly of claim 3 which includes second power circuit means operative to provide power from said socket mounting means to said control circuit means.

11. The detector and light assembly of claim 3 which includes second power circuit means operative to provide power from said socket mounting means to said electrically powered alarm circuit means, said electrically powered alarm circuit means including a battery charger means connected to receive power from said second power circuit means, a battery, and an alarm means, said detector means being connected between said battery and said alarm means and operating to connect said battery to said alarm means in response to an alarm condition, said battery charger means operating to provide power to said control circuit means and said battery.

12. The detector and light assembly of claim 11 wherein said control circuit means includes current pulsing means operative when activated to provide spaced current pulses, means responsive to the activation of said alarm circuit means to activate said current pulsing means, said switching means including solenoid switching means connected to receive spaced current pulses from said current pulsing means, said solenoid switching means operating upon receipt of said current pulses to repetitively make and break the circuit between said socket mounting means and light bulb receiving socket means.

13. The detector and light assembly of claim 12 wherein said first power circuit means includes a manually operable switching means which may be manually activated from an off position where a circuit between said light bulb receiving socket means and said socket mounting means is broken to an on position where a circuit is completed between said light bulb receiving socket means and said socket mounting means.

14. The detector and light assembly of claim 13 wherein said control circuit means operates upon activation of said alarm circuit means when said manual switching means is in the on position to switch said manual switching means to the off position, said solenoid switching means operating with the manual switching means in the off position to control the circuit between said socket mounting means and light bulb receiving socket means.

* * * * *